US005667078A

United States Patent [19]

Walach

[11] Patent Number: 5,667,078

[45] Date of Patent: Sep. 16, 1997

[54] APPARATUS AND METHOD OF MAIL SORTING

[75] Inventor: Eugene Walach, Kiryat Motzkin, Israel

[73] Assignee: International Business Machines Corporation, Armonk, N.Y.

[21] Appl. No.: 446,362

[22] Filed: May 22, 1995

[30] Foreign Application Priority Data

May 24, 1994 [GB] United Kingdom ..... 9410372

[51] Int. Cl.[6] ..... B07C 5/00

[52] U.S. Cl. ..... 209/584; 209/900

[58] Field of Search ..... 209/584, 583, 209/900, 3.3

[56] References Cited

U.S. PATENT DOCUMENTS 5,009,321 4/1991 Keough ..... 209/900 X
5,031,223 7/1991 Rosenbaum et al. ..... 382/1
5,249,687 10/1993 Rosenbaum et al. ..... 209/900 X

*Primary Examiner*—David H. Bollinger
*Attorney, Agent, or Firm*—Kenneth A. Seaman

[57] ABSTRACT

Disclosed is a method for sorting a set of mail items according to a predefined delivery sequence, including the steps of generating first sequence number for each subset of mail according to its destination address, sorting the first subset into batches according to the first sequence number, associating one of the first sequence numbers corresponding to the destination addresses of the mail items in the first subset, generating a second sequence number sorting the second subset into batches according to the second and first sequence numbers disregarding N of the most significant digits of the first sequence number, interleaving the batches of mail items from the first and second subset; and sorting the mail items according to the N most significant digits of the first sequence numbers. In this way, all the mail is sorted in sequence, but sorting of the mail can begin prior to all the mail being physically present at the sorter or its location in the sorting scheme being known. A system and machine for practicing the method are also contemplated.

6 Claims, 11 Drawing Sheets

APPARATUS AND METHOD OF MAIL SORTING

BACKGROUND OF THE INVENTION

1. Field of the Invention

The invention relates to an apparatus and method of mail sorting.

2. Description of the Prior Art

In modern mail sorting offices each item of mail passes through two separate processing stages. In the first stage, address information is extracted from the mail items and corresponding address or sorting barcodes are printed on each item. In the second stage, the mail items are sorted using automatic sorting machines into a predetermined sorting sequence.

Both stages are time consuming and expensive in terms of the resources required. For instance, the second stage requires large numbers of mail sorting machines each having a large number of sorting bins. Due to the cost of manual sorting, the tendency is to increase the number of sorting tasks for which automatic sorting machines are used.

However, automatic mail sorting machines are themselves very expensive and therefore it is of paramount importance that the most efficient use possible be made of them.

Nowadays, computers are generally used to control and optimize the sorting process in order to reduce the number of bins required in the sorting machines and the number of times each mail item or a batch of mail items being sorted must pass though a sorting machine.

For example, it is possible to reduce the sorting time required by sorting the mail items into a delivery sequence defined by the destination addresses as follows. Consider an imaginary village having 1000 possible addresses in which, on any given day, an average of 100 pieces of mail need to delivered to 100 different ones of these addresses and a sorter is available which has 10 pockets. If sorting is performed according to address number then the mail will have to be passed through the sorter 3 times (equal to $\log_{10}1000$), If, on the other hand, each mail item is assigned, via suitable processing of address information extracted from the item, a sequence number and the mail is sorted according to the sequence numbers only 2 passes are required (equal to $\log_{10}100$).

However, in order to implement this method it is necessary to know the correct mail sequencing and for all the mail items to be sorted to be physically present at the sorting location before the start of the sorting process. In practice, since the mail will be arriving at the sorting location from a number of different places, it will not normally all arrive at the same time. Therefore, the need to wait until it has all arrived before starting the sort process creates a bottleneck in the process which leads to a delay.

SUMMARY OF THE INVENTION

An advantage of this invention is to provide a method for sorting mail items into sequence, which does not require all the mail items to be sorted to be physically present at the sorting location before the sorting starts and thereby enables more efficient use to be made of the sorting machines available.

To achieve this advantage, the invention provides a method for sorting a set of mail items, each having an associated destination address, according to a delivery sequence, the method comprising the steps of:

generating for each of a first subset of the mail items to be sorted a first sequence number according to the position of their respective destination addresses in the delivery sequence;

sorting, using a sorting machine, the first subset of the mail items into batches according to the first sequence number disregarding a number N of the most significant digits thereof;

characterized by associating, with each of a second subset of the mail items to be sorted, one of the first sequence numbers corresponding to the destination addresses of the mail items in the first subset between which their respective destination addresses lie in the delivery sequence;

generating, for each of the second subset of mail items, a second sequence number according to the position of their respective destination addresses in the delivery sequence among the destination addresses of mail items in the second subset associated with the same first sequence number;

sorting, using a sorting machine, the second subset of the mail items into batches according to the second sequence number and the first sequence number disregarding N of the most significant digits of the first sequence number; interleaving the batches of mail items from the first subset of mail items and from the second subset of mail items;

and sorting the mail items according to the N most significant digits of the first sequence numbers.

In this way, the sorting of the first subset of mail items need not wait until the second subset of mail items has arrived at the sorting center. This can increase the time window available for the whole sorting process and therefore lead to more efficient use of the available sorting resources.

Of course, other objects and advantages of the present invention will be apparent to those skilled in the art of sorting objects based upon the following description of the preferred embodiment, the appended claims and the accompanying drawings.

BRIEF DESCRIPTION OF THE DRAWINGS

An embodiment of the invention will now be described by way of example only with reference to the accompanying drawings wherein.

DETAILED DESCRIPTION OF PREFERRED EMBODIMENT

The invention is embodied as part of the known mail distribution system described in U.S. Pat. No. 5,031,223 the contents of which are incorporated herein by reference, although, of course, application to other types of mail distribution system is not excluded. Only a brief description of the system will be given here, but further details can be found in U.S. Pat. No. 5,031,223.

Figure 1:
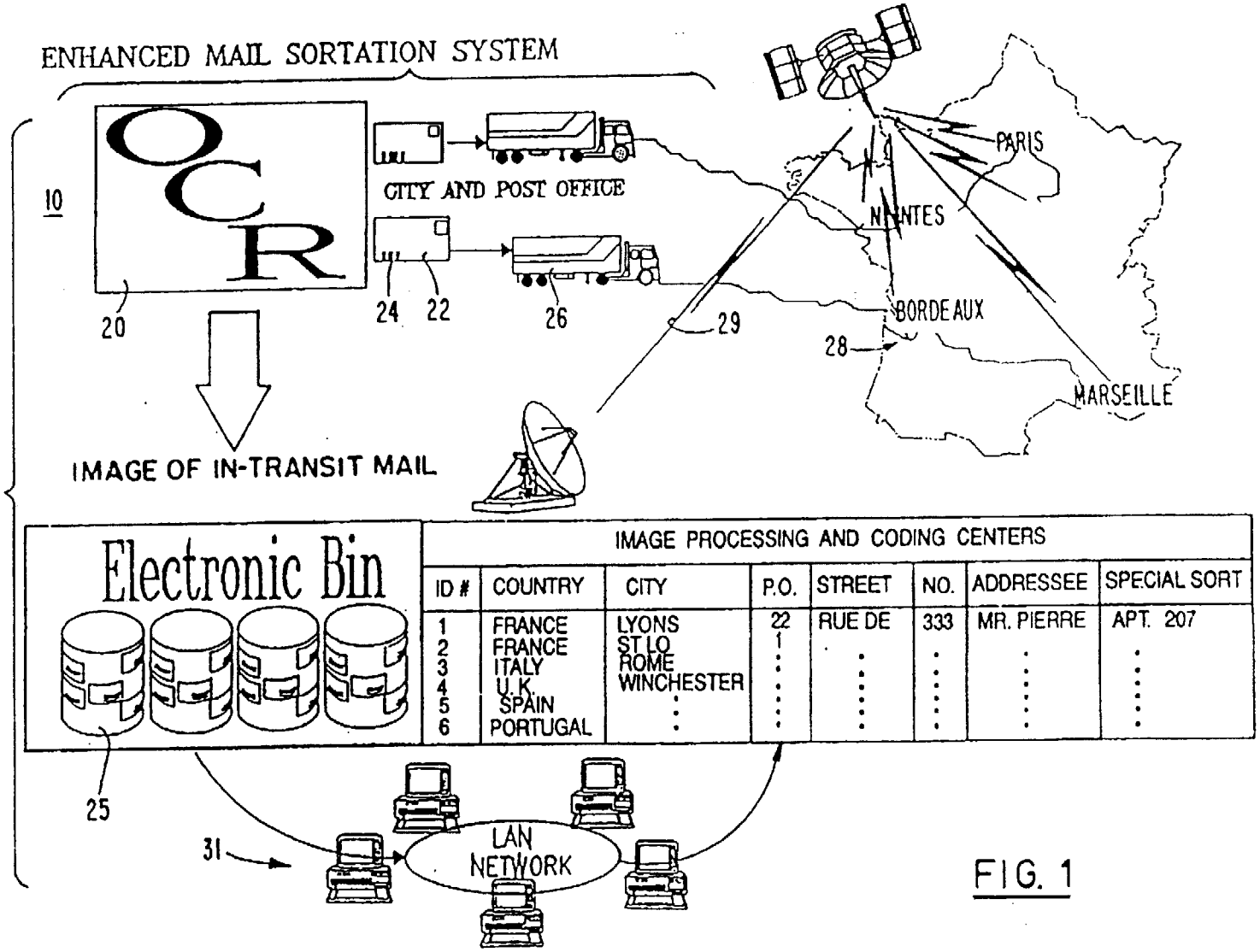
FIG. 1 is a schematic diagram of a mail distribution system.

FIG. 1 is a schematic diagram of the mail distribution system. Mail pieces which originate at the sending location 10 are read through optical character recognition machine (OCR) 20 and distributed to receiving locations 28.

Figure 2:
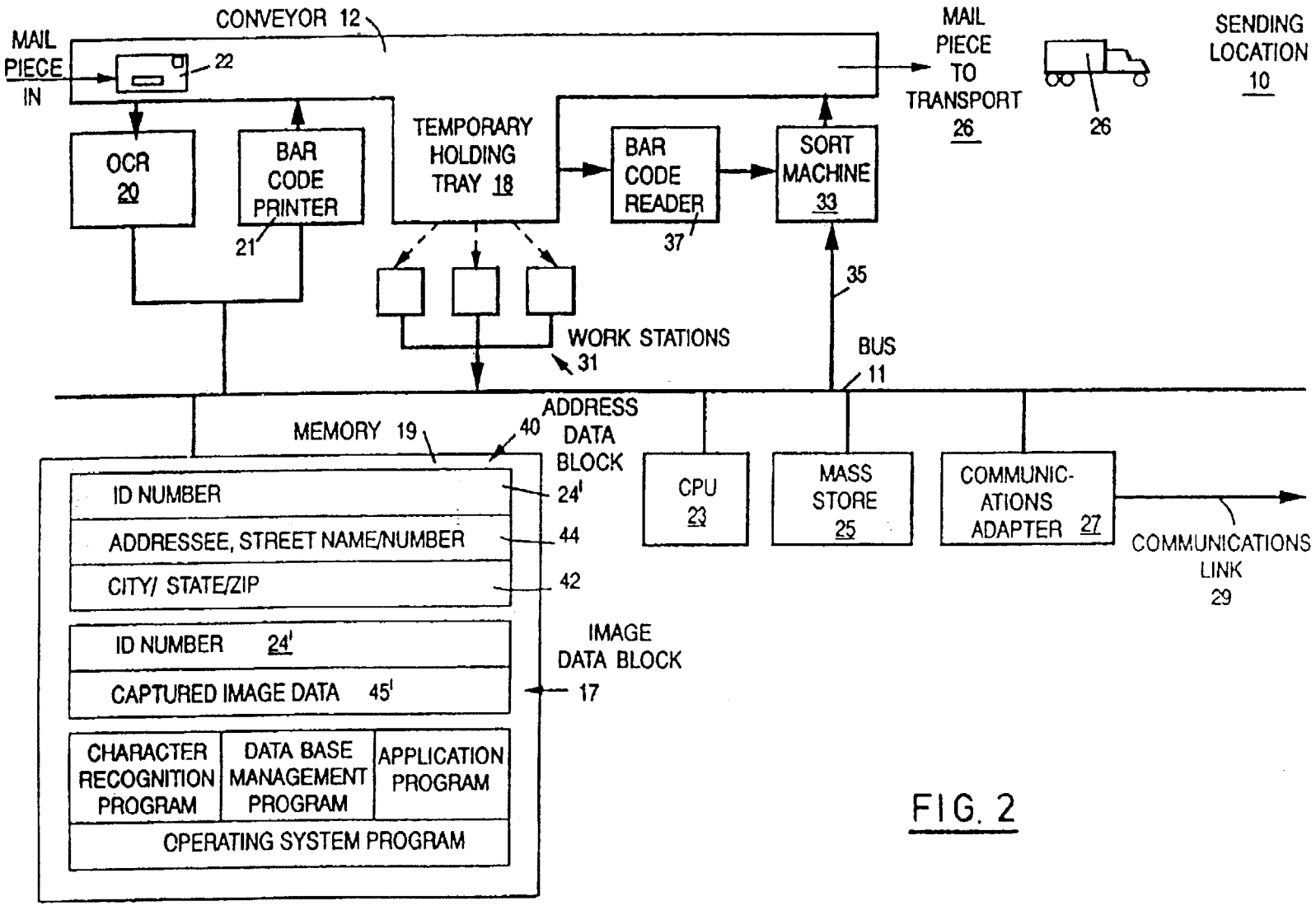
FIG. 2 is an architectural diagram of a sending location.

FIG. 2 is an architectural diagram of a sending location 10. The data processing system shown in FIG. 2 includes CPU 23 which is connected by means of bus 11 to memory 19, OCR 20 and bar code printer 21. The system further includes workstations 31, bar code reader 37, sorting machine 33 connected by the connection 35, mass store 25 and communications adapter 27 all interconnected by the system bus 11. The communications adapter 27 communicates over communications link 29 to the receiving locations 28.

Figure 3:
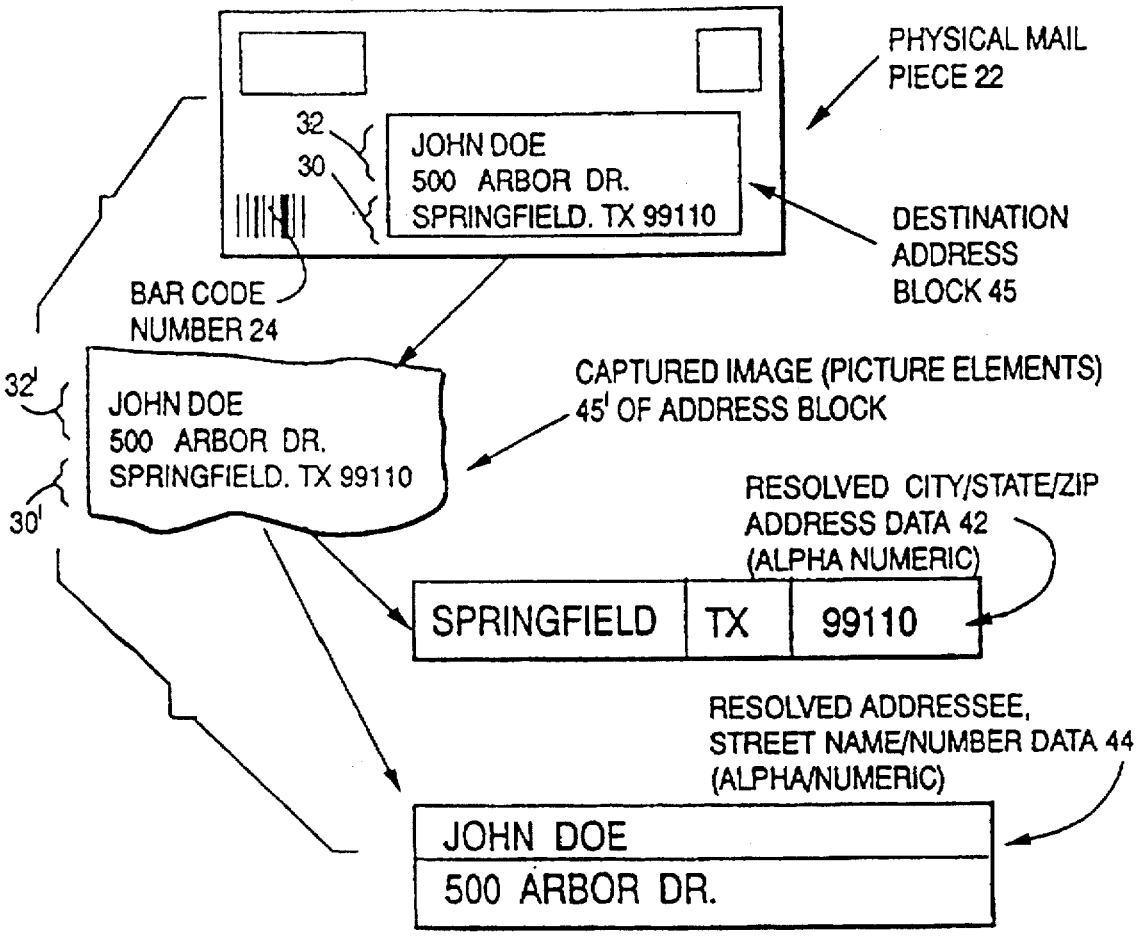
FIG. 3 illustrates a physical mail piece.

FIG. 3 illustrates a physical mail piece 22 which has a destination address block 45 which includes city/state/zip address data 30 and addressee, street name and street number data 32. The OCR 20 scans the physical mail piece 22 and captures an image 45' of the address block as a two-dimensional array of picture elements in a bit plane. The captured image 45' includes an image 30' of the city/state/zip information 30 and it further contains an image 32' of the addressee and street name and street number 32. The OCR 20 resolves the image 30' of the city/state/zip information 30 into an alphanumeric character string of resolved address data 42.

As is seen in FIG. 2, at the sending location a mail piece is input to a conveyor 12 and passes beneath the OCR 20 where it is scanned. The mail piece then continues on the conveyor belt and the bar code printer 21 prints a serial number 24 onto the mail piece 22.

In its normal operation, the OCR 20 reads the second portion 30 of the address block 45 consisting of the city, state, country and zip code destination, and will enter this into the resolved address data block 40 in the memory 19 shown in FIG. 2.

The resolved address data block 40 shown in FIG. 2 has two portions, the first portion 42 stores the resolved alphanumeric string for the city, state, zip code or country as was recognized by the OCR 20 in its scanning operation. The second portion 44 of the resolved address data block will contain the resolved addressee and street name and street number information.

The resolved city, state, zip code and/or country information in portion 42 of the resolved address data block is output to the sorting machine 33 and is used to physically sort the mail piece 22 into an appropriate pocket in the sorting machine. The physical pocket in the sorting machine 33 is associated with a particular mode of transportation, whether by airplane, truck, train or other mail transportation medium, which is destined to the city and state and country named in the destination address block 45.

After the first sorting operation at the sending location 10, the mail piece 22 is physically loaded onto a carrier 26 such as a truck, airplane or other appropriate transportation medium, and is physically transported to the postal destination 28.

While the mail piece is travelling to the receiving location the addressee and street name and street number information is processed off line and resolved into an alphanumeric string 44. Once the addressee and street name and street number information is converted into an alphanumeric string in portion 44 of the address data block 40, the resolved address data block 40 can be transmitted through the communications link adaptor 27 and over the communications link 29 to the destination location 28.

As the mail piece 22 passes out of the OCR 20, the bar code printer 21 prints a bar code 24 representing and identification number 24' which will allow the mail piece 22 to be re-associated with the information in the resolved address data block 40. That re-association is made at the receiving location 28 for the mail piece, where the resolved addressee, street name and street number information 44 can be associated with the particular mail piece 22 by the identity of the identification number 24.

At the destination location 28, the resolved address data block 40 will have its information used for providing the addressee and street name and street number information to enable the mail piece to be sorted at the destination location 28.

Figure 4:
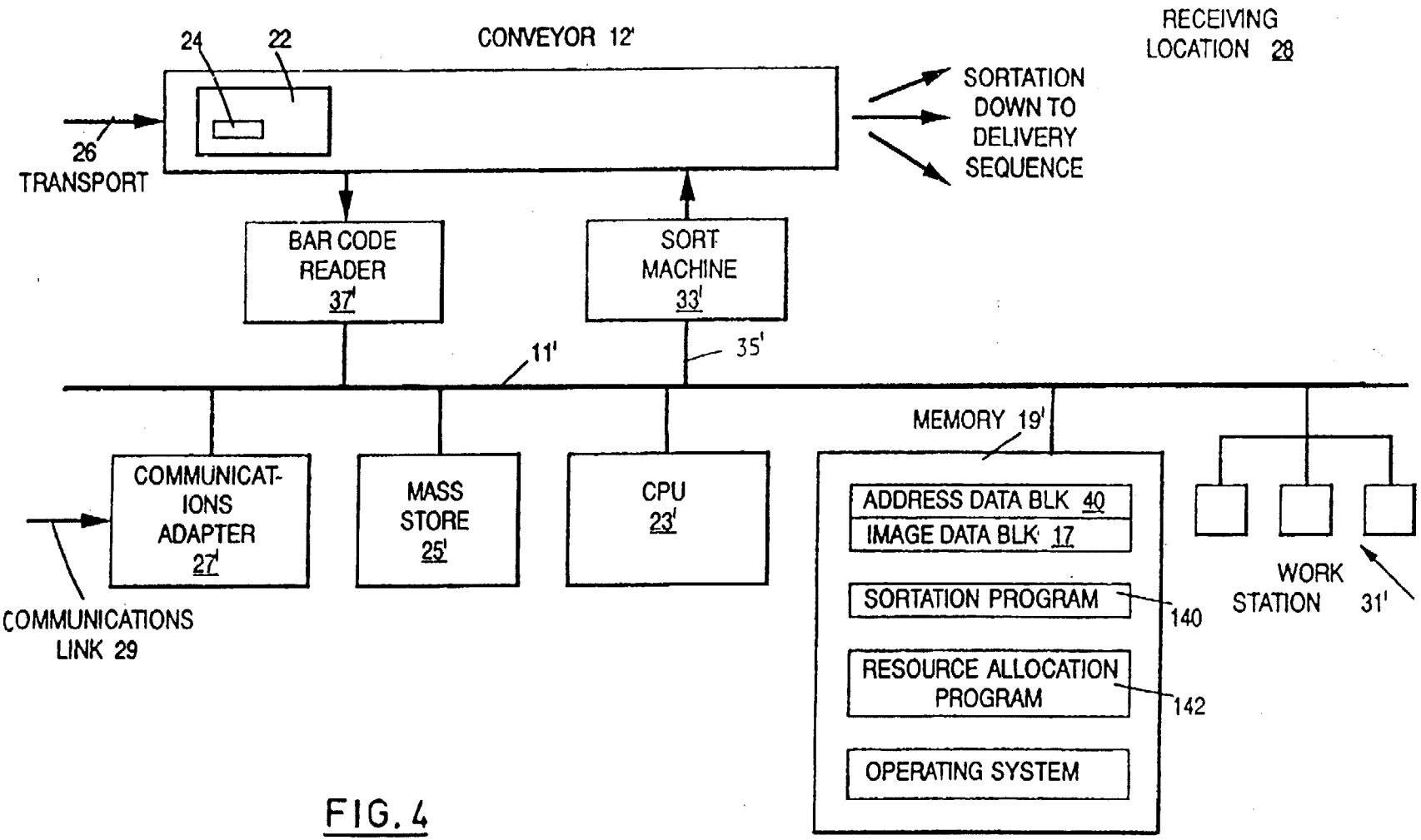
FIG. 4 is an architectural diagram of a receiving or destination sorting location.

FIG. 4 shows an architectural diagram of the receiving location 28, where the transport 26 delivers the mail piece 22 onto the conveyor 12'. The data processing system shown in FIG. 4 includes CPU 23' which is connected by means of bus 11' to memory 19', and bar code reader 37'. The system further includes workstations 31', and sorting machine 33' connected by the connection 35', mass store 25' and communications adapter 27' all interconnected by the system bus 11'. The communications adapter 27' communicates over communications link 29 to the sending locations 10.

The mail piece 22 has its bar code 24 read by the bar code reader 37' and that serial number is then associated by the CPU 23' with the address data block 40 which has been received over the communications link 29 by the communications adaptor 27'. The addressee, street name and street number information 44 in the received address data block 40 is then applied by the CPU 23' to the sort machine 33' to perform the sorting of the mail piece 22 down to the delivery sequence. The sorted mail piece 22 can then be locally delivered at the receiving location 28 to the addressee at his particular street and street number.

Figure 5:
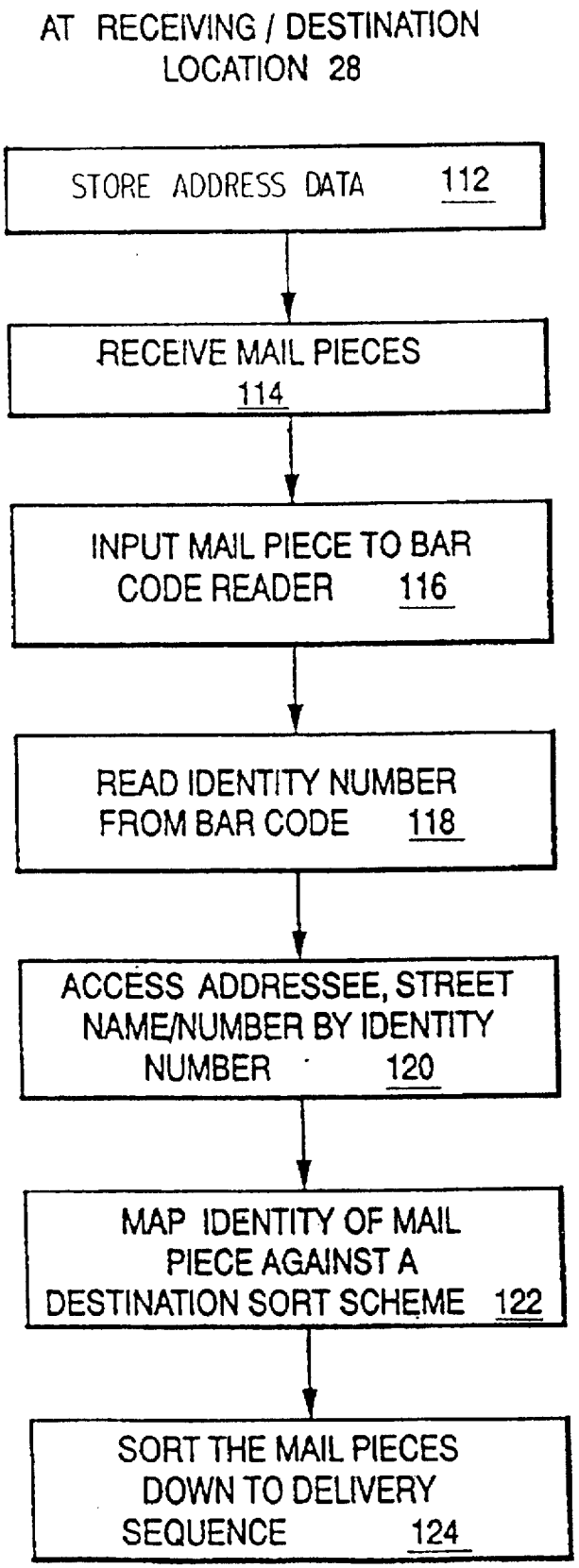
FIG. 5 shows the process steps at the receiving location.

FIG. 5 shows a flow diagram of the general sequence of operational steps performed at the receiving location 28. In step 112, the address data block 40 is received over the communications link 29 by the communications adapter 27' in FIG. 4. In step 114, the transport 26 delivers the physical mail pieces 22 which are input to the conveyor belt 12' in step 116. In step 118, the mail piece 22 has its bar code 24 read by the bar code reader 37'. The bar code ID is applied in step 120 to access the addressee, street name and street number information from the address data block 40 which is now stored in the memory 19', after having been received by the communications adapter 27'. This addressee, street name and street number information is then output by the CPU 23' to the sort machine 33' to sort the mail piece 22 on the conveyor 12 so that sorting can be performed down to the delivery sequence. The sorting steps in step 122 and 124 are resolved in the sorting of the mail piece to an appropriate local mail route, in a street name order and address number order and in a building floor order, if appropriate.

A sorting program 140 and a resource allocation program 142 are present in the memory 19' at the receiving location 28 in FIG. 4, to carry out the sorting of the mail pieces down to the delivery sequence and to carry out the provision of resource allocation information to enable local postal management to have advance warning of a need for additional resources to handle the physical mail pieces to be delivered to the receiving location.

Figure 6:
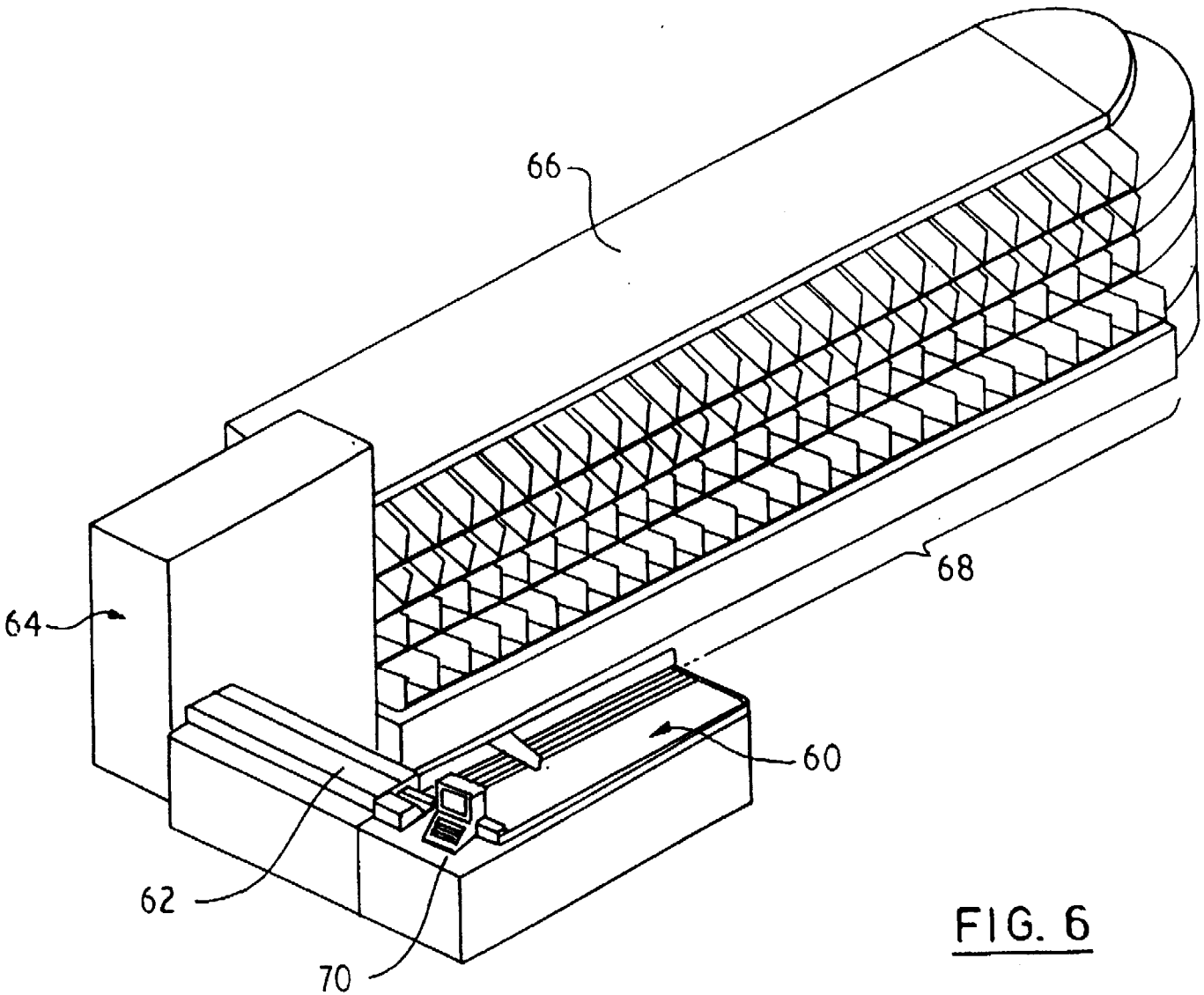
FIG. 6 shows a sorting machine.

Sorting machine 33' is of known type and is illustrated in FIG. 6. It comprises mail loading bay 60, bar code reader 62, letter distribution unit 64 and stacker units 66. Mail items input at loading bay 60 are sorted one by one into pockets or bins 68. The sorting machine operates under the control of computer 70 and sorting program 140.

Figure 7:
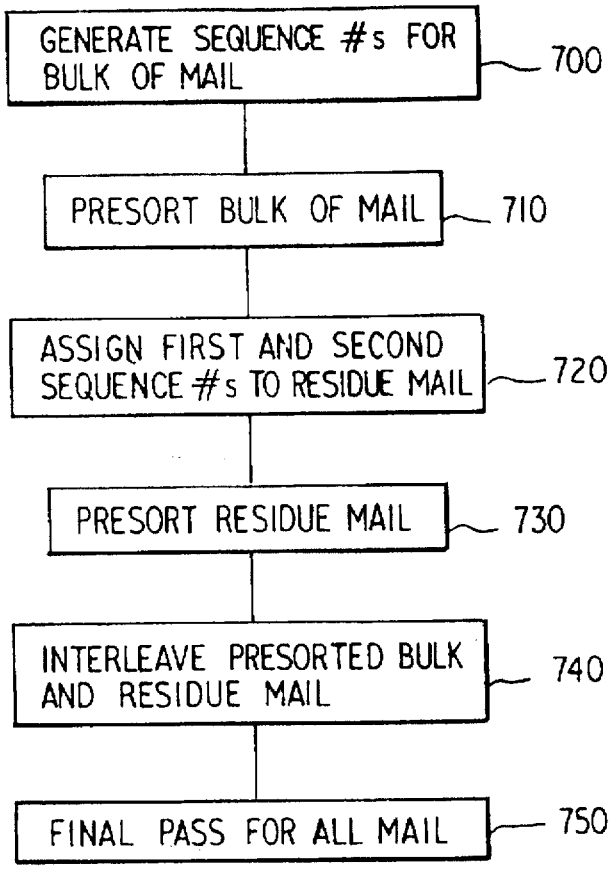
FIG. 7 is a flow diagram showing a sorting process.

FIG. 7 is a flow diagram illustrating the sorting process which is performed by sorting machine 33 under the control of the sorting program 140. It proceeds as described below. The sorting process can be started once a large proportion, but not all, of the mail has arrived at the receiving location.

A first sequence number is generated 700 from the resolved address information according to the position of the addresses in the delivery sequence. This sequence number is associated with the ID 24 of the mail piece 22 using an appropriate look-up table. The bulk of the mail is then pre-sorted in step 710, using sorting machine 33, into batches according to the first sequence number disregarding a number N of the most significant digits. In other words, the sorting process is stopped before the final pass or passes. Separators are then put between the batches so the rest of the mail can be interleaved with them later.

Once the rest of the mail has arrived at the receiving location one of the first sequence numbers corresponding to the mail piece in the bulk of the mail after which the piece of residue mail is supposed to come in the delivery sequence, is associated, again using a suitable look-up table, with each mail piece of the residue mail. A second sequence number is generated to order the set of residue mail pieces coming after the same mail piece of the bulk of the mail. This occurs in step 720.

The residue mail is then presorted in step 730 into batches against the second sequence number and then against the first sequence number disregarding N of the most significant digits of the first sequence number.

The batches of mail items from the bulk of the mail and from the residue mail are then interleaved in step 740 and the final passes of the sorting process, i.e., sorting according to the N most significant digits of the first sequence numbers, are performed in step 750 to put the mail into its final sequence.

Figure 8:
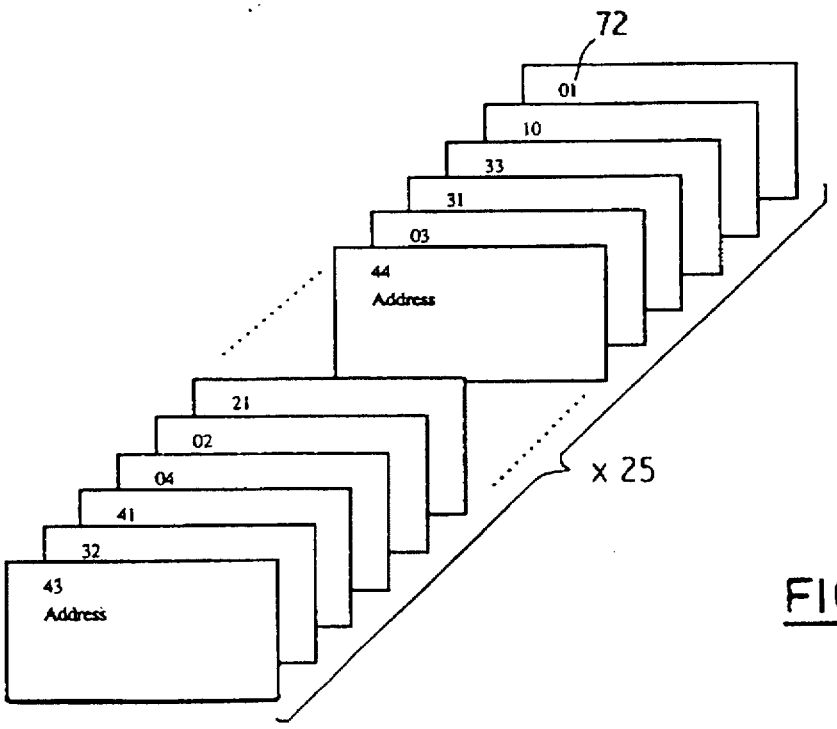
FIGS. 8–12 illustrate a sorting example.

This sorting process is illustrated in FIGS. 8 to 12 which show a simple example of 33 letters being sorted into sequence using a sorting machine with 5 bins. An initial batch of 25 mail items arrive at the sorting center in random order. A sequence is determined from the destination addresses of these mail items and a sequence number 72 is associated with each letter either by printing the sequence number on the letter in a suitable form such as a bar code or by associating the sequence number with the bar code ID 24 on the mail items using an appropriate look-up table. The sequence numbers are expressed in base N, where N is the number of bins in the sorting machine, i.e., in this case base 5. The 25 mail items and their respective sequence numbers are illustrated in FIG. 8.

Figure 9:
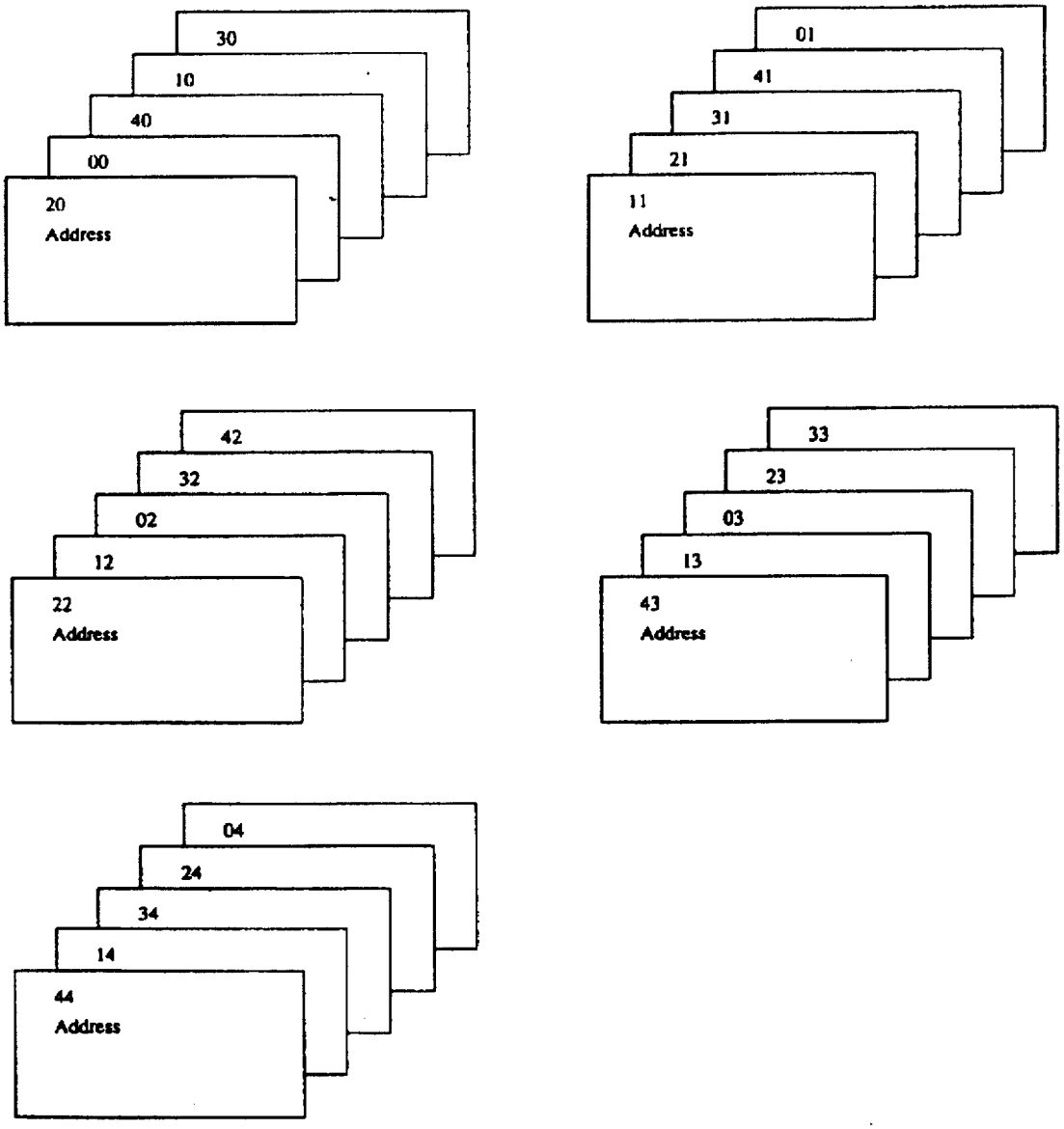
Figure 10:
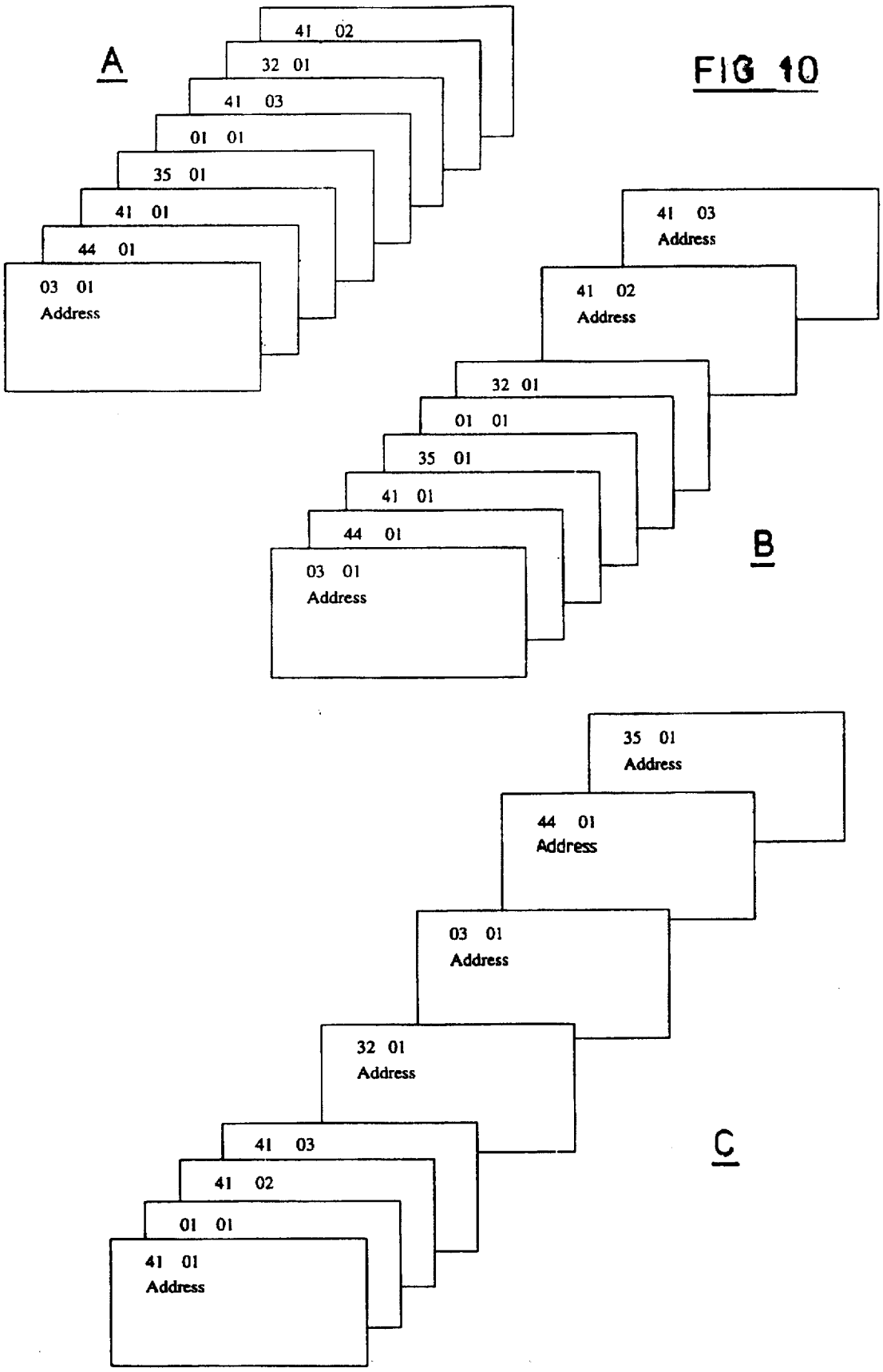

This initial batch of mail items are sorted, using the sorting machine, according to the least significant digits of the sequence number. In this example, only one pass though the machine is required and the resulting 5 batches of mail items are shown in FIG. 9. These batches are stored until the remaining mail items arrive at the sorting location.

The 8 remaining mail items in this example are shown in FIG. 10A. The address information from these mail items is used to identify where in the sequence they come and one of the first sequence numbers is associated with each of these residue mail items. In this embodiment, the first sequence number which is associated with each item of residue mail is the number in the sequence immediately after which the items are supposed to come. In addition, a second sequence number is associated with each residue mail item to order the residue mail items which come immediately after the same one of the first sequence numbers.

The residue mail is then sorted using the sorting machine according to the second sequence numbers and the least significant digits of the first sequence numbers. In this simple example, two passes of the residue mail through the sorting machine are required and the results of these passes are shown in FIGS. 10B and C respectively.

Figure 11:
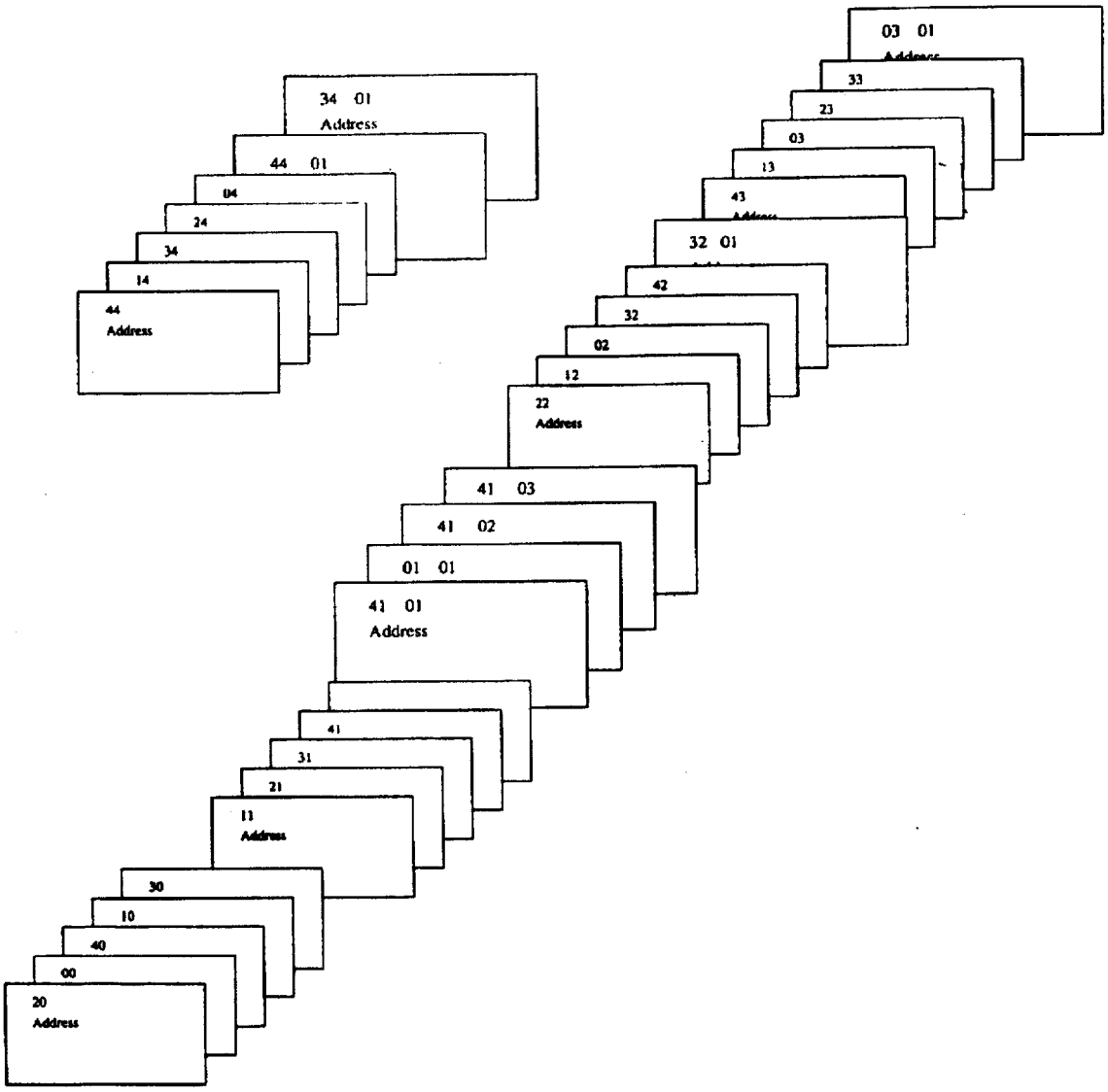

The 5 batches of mail items from the residue mail are interleaved with the batches from the first batch of mail as shown in FIG. 11.

Figure 12:
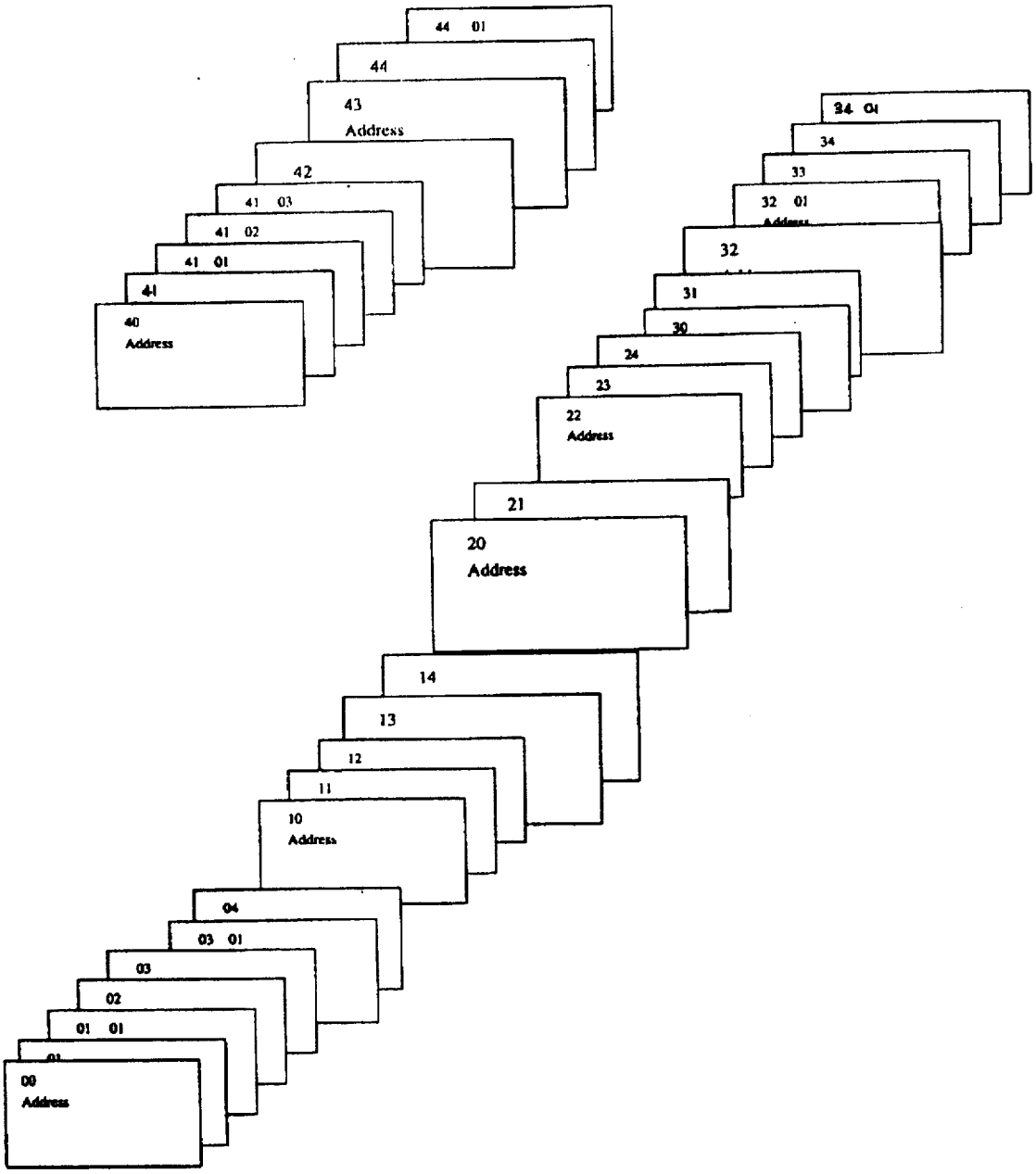

Finally the whole of the mail is sorted according to the most significant digit of the first sequence number. In this example, a single pass of all the mail through the sorting machine is required and the result is shown in FIG. 12.

In this way, all the mail is sorted in sequence, but sorting of the mail can begin prior to all the mail being physically present at the sorter or its location in the sorting scheme being known.

At the expense of the small overhead of having to sort the residue mail in a separate pass through the sorting machine, the window of time available for sorting purposes can be increased as much as two-fold. The result is a drastic reduction in the number of sorting machines required to handle peak mail loads.

Many modifications of the system and method of sorting mail described above will be apparent to those skilled in the pertinent art. Further, some of the features of the present invention can be used without the corresponding use of other features. Accordingly, the foregoing description of the preferred embodiment should be considered as merely illustrative of the principle of the present invention and not in limitation thereof. The scope of the present invention is defined by the claims which follow.

What is claimed is:

1. A method for sorting a set of mail items, each mail item having an associated destination address, according to a predefined delivery sequence, the method comprising the steps of:

generating for each of a first subset of the mail items a first sequence number according to the position of their respective destination addresses in the delivery sequence;

sorting, using a sorting machine, the first subset into batches according to the first sequence number disregarding a number N of the most significant digits thereof;

characterized by associating with each of a second subset of the mail items, one of the first sequence numbers corresponding to the destination addresses of the mail items in the first subset between which their respective destination addresses lie in the delivery sequence;

generating for each of the second subset, a second sequence number according to the position of their respective destination addresses in the delivery sequence among the destination addresses of mail items in the second subset associated with the same first sequence number;

sorting, using a sorting machine, the second subset into batches according to the second sequence number and the first sequence number disregarding N of the most significant digits of the first sequence number;

interleaving the batches of mail items from the first subset and from the second subset; and sorting the mail items according to the N most significant digits of the first sequence numbers.

2. A method of sorting mail including the steps set forth in claim 1 using a sorting machine comprising M bins, wherein the first and second sequence numbers are expressed in base M.

3. A method of sorting mail including the steps of claim 1 wherein the steps of sorting of the first subset of mail items is started before the second subset of mail items has physically arrived at the sorting location.

4. A method of sorting mail including the steps of claim 1 and further including the step of reading a bar code from each mail item comprising an ID number for the item, wherein at least one of the first and second sequence numbers are associated with the ID number.

5. An apparatus for sorting a set of mail items, each mail item having an associated destination address, according to a predefined delivery sequence, the apparatus comprising:

means for generating for each of a first subset of the mail items a first sequence number according to the position of their respective destination addresses in the delivery sequence;

means for controlling a sorting machine to sort the first subset into batches according to the first sequence number disregarding a number N of the most significant digits thereof;

means for associating with each of a second subset of the mail items, one of the first sequence numbers corresponding to the destination addresses of the mail items in the first subset between which their respective destination addresses lie in the delivery sequence;

means for generating for each of the second subset, a second sequence number according to the position of their respective destination addresses in the delivery sequence among the destination addresses of mail items in the second subset associated with the same first sequence number;

means for controlling a sorting machine to sort the second subset into batches according to the second sequence number and the first sequence number disregarding N of the most significant digits of the first sequence number;

means for interleaving the batches of mail items from the first subset and from the second subset; and means for controlling a sorting machine to sort the mail items according to the N most significant digits of the first sequence numbers.

6. A mail sorting apparatus as claimed in claim 5 and further including:

a sorting machine arranged to be controlled by said apparatus;

a conveyor belt for receiving the mail items;

a bar code reader for reading bar codes from each of the mail items;

means for receiving address information for the mail items over a telecommunications network from a sending location; and means for associating the address information received from the sending location with the bar codes read from the mail items, whereby each of the mail items is sorted based on the address information which is associated with a read bar code.

* * * * *